US007618247B1

(12) United States Patent
Niemiec

(10) Patent No.: US 7,618,247 B1
(45) Date of Patent: Nov. 17, 2009

(54) PROGRESSIVE STAGED FLOW TO PRECOMPRESS THE PUMP INTERNAL VOLUME/VOLUMES TO BE DISPLACED

(76) Inventor: Albin J. Niemiec, 79700 Hipp Rd., Romeo, MI (US) 48065

( * ) Notice: Subject to any disclaimer, the term of this patent is extended or adjusted under 35 U.S.C. 154(b) by 161 days.

(21) Appl. No.: 11/590,982

(22) Filed: Nov. 2, 2006

(51) Int. Cl.
*F04C 15/00* (2006.01)
*F04C 2/00* (2006.01)

(52) U.S. Cl. ..... 418/79; 418/61.3; 418/132; 418/133; 418/171; 418/259

(58) Field of Classification Search ..... 418/15, 418/61.3, 75, 77, 79, 80, 131–132, 140, 166, 418/167, 171, 78, 82, 133, 259, 266–268
See application file for complete search history.

(56) References Cited

U.S. PATENT DOCUMENTS 2,989,951 A * 6/1961 Charlson ..... 418/61.3
5,261,796 A * 11/1993 Niemiec et al. ..... 417/371
5,263,818 A * 11/1993 Ito et al. ..... 418/171
6,743,003 B2 * 6/2004 Dong ..... 418/61.3

FOREIGN PATENT DOCUMENTS

JP 06117379 A * 4/1994 ..... 418/170

* cited by examiner

*Primary Examiner*—Theresa Trieu

(57) ABSTRACT

Besides the conventional pump timing in rotary hydraulic devices, a series of constant and variable restrictions have been applied to condition the pressurized flow used to internally precompress the volume or volumes to be displaced. This multiple staged orifices feature reduces the outgassing associated with the pressurized flow passing through a single restriction, such as a metering groove. The pressurization of the outgassed fluid will cause noise and erosive wear of the pump internal containment surfaces.

15 Claims, 8 Drawing Sheets

ALTERNATIVE DESIGN

ALTERNATIVE DESIGN

PROGRESSIVE STAGED FLOW TO PRECOMPRESS THE PUMP INTERNAL VOLUME/VOLUMES TO BE DISPLACED

The present invention is directed to rotary hydraulic devices capable of functioning as pumps, motors, flow dividers, pressure intensifier and the like, and more particularly to vane and gear pumps.

BACKGROUND AND OBJECTS OF INVENTION

Most of the conventional positive displacement rotary pumps apply single stage pressurized flow to hydrostatically precompress the internal fluid volume to be displaced. The throttled pressure of a single staged flow contributes to the release of dissolved air into the internal pump volume to be displaced. The entrained air bubbles are imploded during the pump precompression and discharge cycles. Noisy operation and erosive wear are encountered.

To reduce the outgassing in the pressurized flow encountered in the precompression cycle, a series of constant and variable restrictions are located in the flow passage to alter the throttled pressure.

The application of the progressive staged flow for precompressing the internal pump volume to be displaced is described in typical vane, gerotor, and spur gear pumps. The invented precompressive staged flow feature is also applicable in other positive displacement rotary pump designs.

SUMMARY OF THE INVENTION

The present invention can be applied to most positive displacement rotary pumps, which feature transition zones between the inlet and discharge periods. During the inlet to outlet transition zone the pump volume to be displaced needs to become pressurized to that of the discharge pressure. The conventional method for compressing this volume is to provide pressurized flow through designed metering grooves on the valve face. When the pump intake volume is not completely filled the metering groove provide the single restrictive orifice for the displaced fluid to suddenly return and complete the pump filling; this rapid reversed flow is associated with increased outgassing and turbulence that produce cavitation wear and noisy operation.

The present invention consists of providing pressurized flow through multistaged restrictive openings to precompress the volume to be displaced. With multistaged orificing the precompressive flow contains considerably less outgassing, which results in quieter operation and reduced erosion wear.

A rotary vane hydraulic device generally includes a housing, a rotor mounted for rotation within a housing and a plurality of vanes individually slideable disposed in corresponding radially extending peripheral slots in the rotor. A cam ring radially surrounds the rotor and has an inward directed surface forming a vane track and one or more fluid pressure cavities between the cam surface and rotor; also there are one or more corresponding fluid inlet cavities. In such devices the vanes as followers are adapted to follow the cam track and provide proper sealing between the inlet and outlet porting correlated with the fluid inlet and fluid outlet zones. During operation of such device, the vanes are urged outwardly and into engagement with the cam track by centrifugal force and also by providing a controlled pressure unbalanced condition between the vane tip engaging the cam surface and the inner surface of the vane within the rotor slot.

Inlet and outlet passages in the housing feed and receive hydraulic fluid to and from the cavity or cavities within the rotating displacement pump.

In most conventional vane pumps the intervane volumes in transition zone of inlet to discharge oil are precompressed to the discharged pressure by throttled discharge flow via a metering groove located at the beginning of the outlet port. The resulting single pressure staged throttled flow contains a considerable amount of outgassing, which causes audible noise and erosive wear attributed to the implosion of the formed gas bubbles during pressurization.

One of the principle objectives of the present invention is to provide a rotary flow restrictive feature in vane pumps that reduces the outgassing during precompression. The multistaged restrictions in the interfaced porting reduces the amount of outgassing in the fluid volume to be displaced during precompression.

The present invention consists of a rotor with porting that registers with strategically located access ports in the pump valve faces of the axial containment surfaces and directs pressurized fluid flow through a series of variable and constant restrictions to precompress each intervane volume prior to displacement.

Each rotor vane slot segment has a radial port located on the periphery and directed inward to intersect with an axially directed passage which exits at both sides of the rotor to provide two axial ports.

On each pump valve face two access ports are radially and angularly located to correspond to the axial ports of two consecutive rotor vane slot segments. One access port strategically located in the inlet to discharge transition zone; the other access port is strategically located in the displacement zone. Both of the access ports are connected by a passage located beneath or on the surface of the valve face.

When the intervane volume is sealed from the inlet port, the axial ports in the rotor begin to register with the corresponding access ports on the valve faces. Pressurized flow enters the radial port in the rotor and is directed through the axial ports into the access ports in the valve face. This pressurized flow continues through the connecting passage and out the access ports located in the inlet to pressure transition zone and into the registered opening of the axial ports and out the radial port in the rotor. The throttled pressurized flow enters and precompresses the intervane volume of fluid in the inlet to discharge transition zone.

The radial porting in the rotor segments, the varied opening of the axial ports in the rotor registering with the access port in the valve faces, and the connecting passage provide the multistaged restrictions for reducing the outgassing associated with throttled pressurized flow.

The afore-described precompression flow sequence occurs for each intervane volume of single and multi-displacement cycles per revolution vane units.

A simplified and preferred version of the afore-described design would replace the axial passage and its axial ports with radial grooves open to the outside diameter on both sides of the rotor. The arcuately shaped corresponding access grooves on the side plate would register with the radial grooves on the rotor and provide the multistage restrictions to meter the pressurized flow into the intervane volumes to be displaced.

The gerotor is positive displacement gear type unit consisting of two elements, an inner rotor and an outer rotor. The outer rotor has one or more teeth than the inner rotor and has its centerline positioned at fixed eccentricity from the drive axis of the inner rotor and shaft.

Although gerotor units come in a variety of geometric configurations, materials, and sizes all gerotor sets possess the basic principle of having conjugately-generated tooth profiles which provide continuous fluid-tight sealing during the pumping operation.

As the rotors rotate about their respective axes, fluid is drawn from the inlet port into the enlarging intertooth space to its optimum volume. When the intertooth space is sealed from the inlet port, it becomes subjected to precompression by multistaged metering flow from the discharge chamber. This metered flow is directed through multistaged restrictions to minimize the outgassing associated with pressurized flow passing through a single stage metering groove. The multistaged restrictions consist of a radial port centrally located on the minor diameter of the inner rotor and between each pair of teeth. Each radial port is inwardly extended to intersect an axial passage which created an axial port on both sides of the inner rotor.

Two access port are located on each axial retaining walls of the rotating group which consists of the inner and outer rotors. The access ports are located to radially and angularly correspond with at least two (2) consecutive axial ports of the inner rotor. On each axial retaining wall, an access port is located in the inlet to discharge transition zone and at a position to begin registering with axial port in the inner rotor when the intertooth space is sealed from the inlet chambers. On each axial retaining wall the other access port is located in the discharge zone to identically sequence its opening with the corresponding axial port. The access ports are connected with an arcuately shaped passage, which is located beneath or on the surface of the retaining wall.

When the two (2) consecutive axial ports begin registering with the two (2) access ports on the axial retaining walls, pressurized flow enters the radial port of the inner rotor and is axially directed to exit into the access ports in the axial retaining wall. The pressurized flow continues in the connecting passage to exit into the axial ports and through the radial port into the intertooth space that completed the inlet cycle and precompress the entrapped volume of fluid.

The continuously varied opening of the registered axial ports in the inner rotor with the access ports in the retaining walls and the selected sized connected passage provide the multistage restrictions for the pressurized flow to precompress each intertooth volume to be displaced.

A simplified embodiment of the present invention would replace the axial passage in the inner rotor with radial grooves on both sides of the inner rotor. The radial grooves would be open at the minor diameter and inwardly extended to register with the access ports on the retaining valve surfaces.

Another gear pump design consists of two spur gears accurately centered and closely fitted in a housing. The pumping chambers formed between the gear teeth are enclosed by a housing center section and side plates which possess the pump timing.

A partial vacuum is created in the pump inlet as the rotating gears unmesh. Fluid is drawn into the intertooth spaces and carried by the rotating gears to the region where the gears mesh and the entrapped fluid volumes are displaced. The pump timing on the side plates include grooves that originate at the discharge and surround the periphery above the minor diameter of both gears. This groove is terminated short of the inlet zone to allow for a minimum one tooth seal. This design strategy provides a radial hydrostatic pressure force to prevent the engaged gear teeth from mechanically separating because of the pressure angle of the meshed tooth engagement. Also, the wrap-around pressure distribution reduces the net radial hydrostatic pressure force supported by the journal bearings.

The present invention includes the following modification to the typical spur gear pump. At the minor diameter and between each pair of gear teeth a selected size radial groove is inwardly located on one side or both sides of the spur gear. An arcuately shaped access groove is located on the valve face of each side plate in the pressurized regions to correspond with the radial grooves in the gears. The beginning location of the access grooves in the side plate registers with the radial groove when the intertooth space completes its inlet cycle and the trailing tooth seals the discharge pressure from the inlet. The radial groove preceding the registering radial groove is engaged with the access groove in the side plate and discharged pressure flow will enter and meter out by the trailing radial groove into the intertooth space that completed the inlet cycle. The interfacing of the gear radial grooves and the access grooves on the side plate provide varied and constant openings (orifices) for throttling the pressurized flow to precompress the intertooth volumes to be displaced.

The aforementioned events are performed for each intertooth space completing its inlet cycle.

As an option, a pressure metering groove at the discharge pressure port of the side plates can be applied to supplement the multistaged precompression.

DETAILED DESCRIPTION OF PREFERRED EMBODIMENTS

Figure 1A:
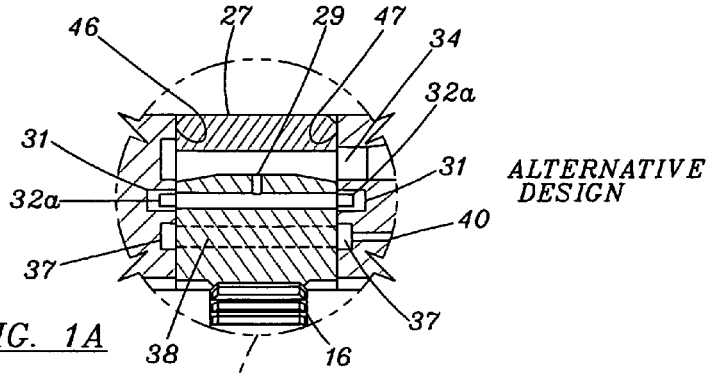
FIG. 1A is a fragmental axial view of an alternative design for connecting flow path between access ports.
Figure 1:
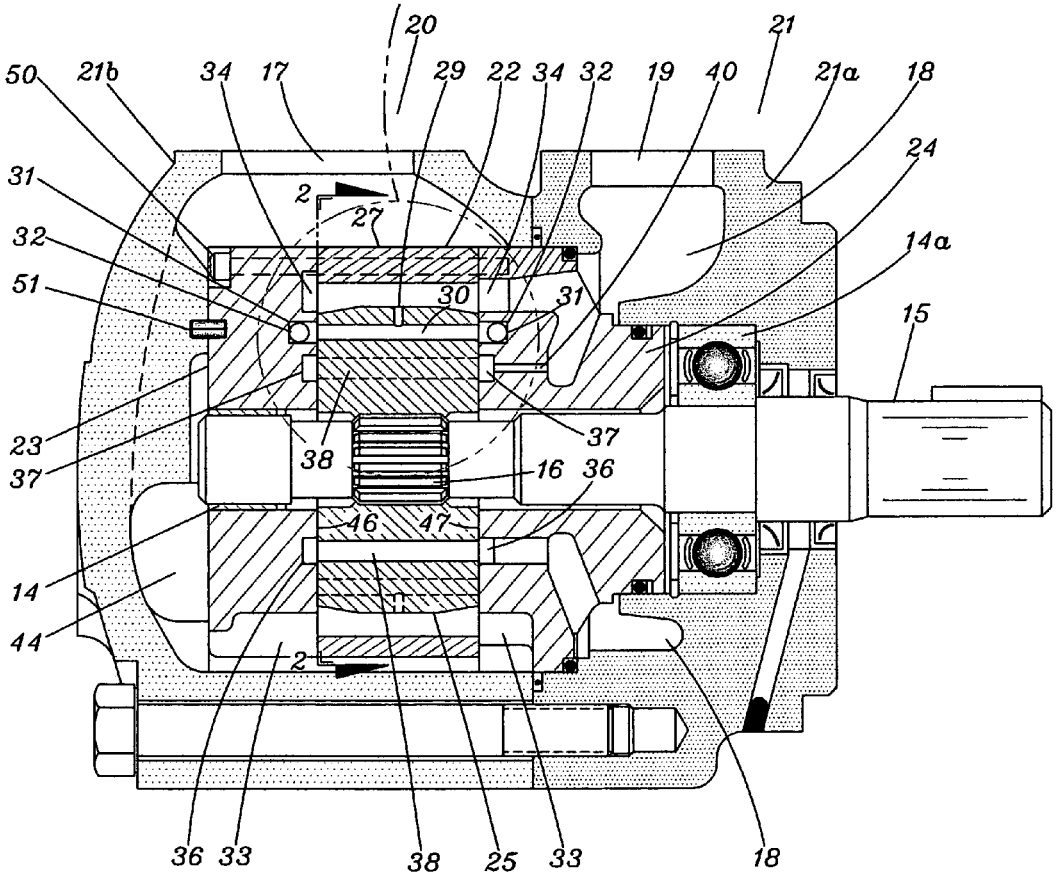
FIG. 1 is an axial section view along the line 1-1 in FIG. 2 of a pressure energy translating device, vane pump embodying the invention.
Figure 2A:
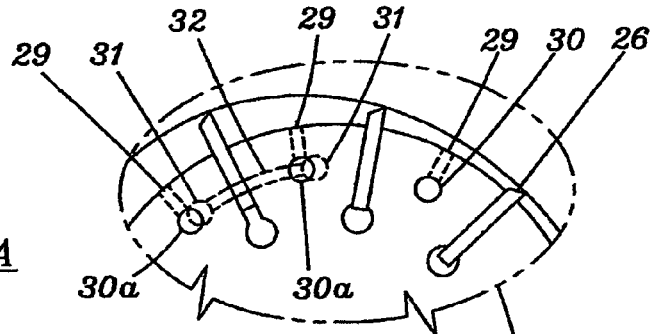
FIG. 2A is an enlarged fragmental elevational view of porting supplying precompressive flow shown in FIG. 2.
Figure 2:
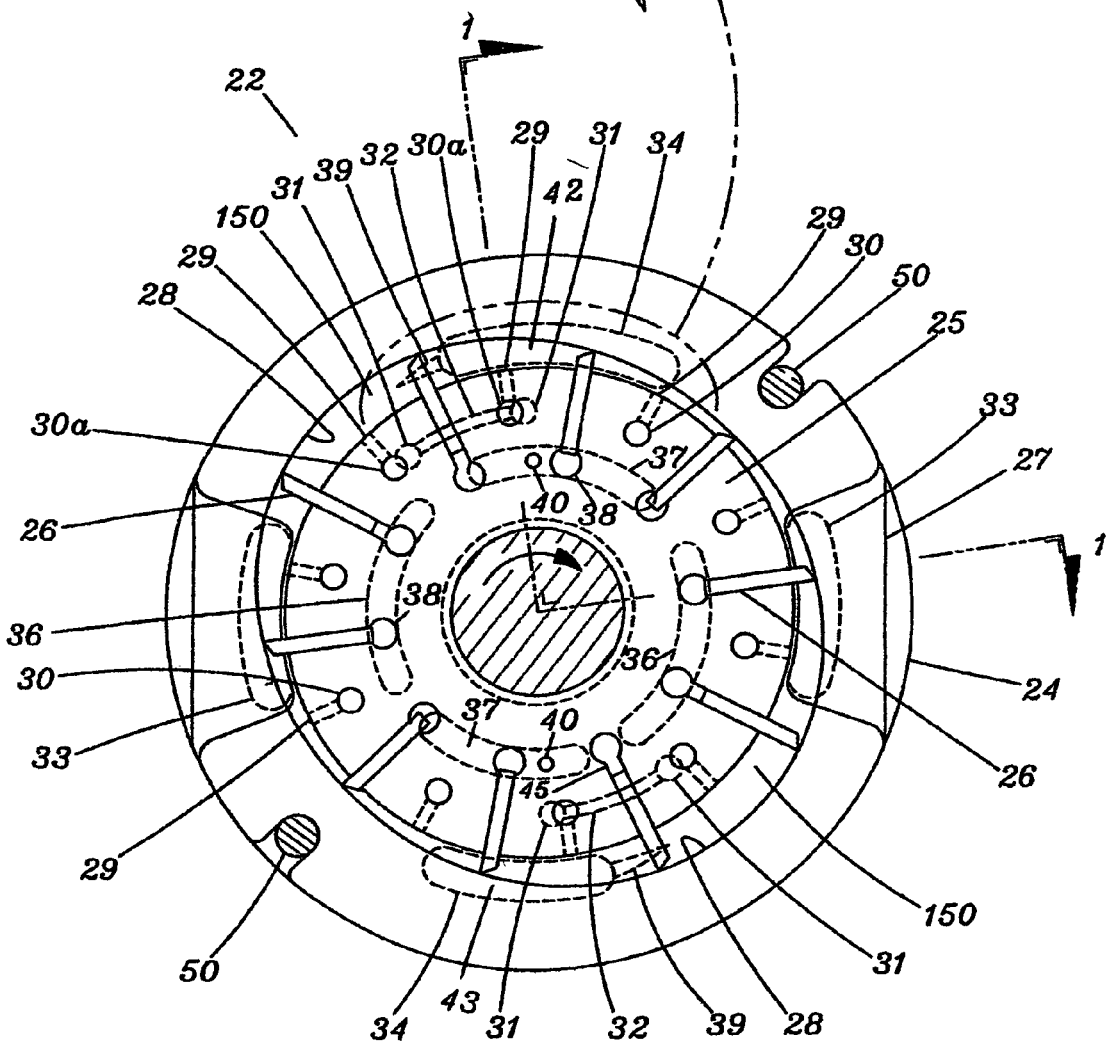
FIG. 2 is a sectional elevational view taken along the line 2-2 in FIG. 1.
Figure 3:
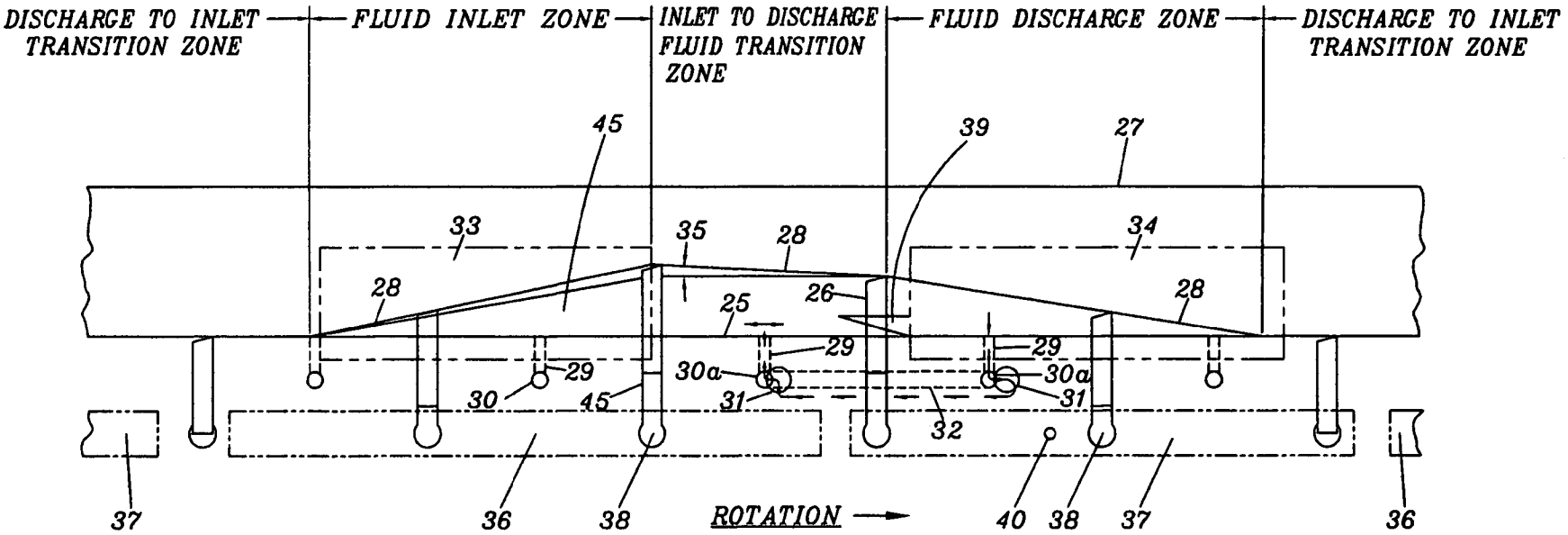
FIG. 3 is a linear layout of the vane pump cycles and the embodying invention.

Referring to FIGS. 1, 2 and 3, therein is shown a rotary sliding vane pump 20 comprising of a housing 21 and a cartridge subassembly 22. The housing 21 comprises of a body 21*a* and cover 21*b*. The cartridge 22 includes a cam ring 27 sandwiched between support plates side 23 and 24. The body 21*a* provides an outlet connection port 19 which is directly connected to a discharge chamber 18 formed between the body 21*a* and the support plate 24. The pair of discharge ports 34 in the support plate 24. The pair of discharge ports 34 in the support plate 24 open into the discharge chamber 18. The cover 21*b* provides a supply connection port 17 leading into a pair of fluid inlet openings 33 formed in support plates 23 and 24.

A rotor 25 is rotatably mounted within cam ring 27 on the spline 16 of shaft 15 which is rotatably mounted within bearing 14 in support plate 23 and a ball bearing 14*a* mounted in body 21*a*.

Cam ring 27 has an internal contour 28 which is substantially oval in shape and which together with the periphery of the rotor 25 and the adjoining axial support surfaces 46 and 47 define two radially opposing pumping chambers 42 and 43; each of which traverse the fluid inlet, fluid transition and fluid outlet zones which are displayed in FIG. 3. The fluid inlet zones comprise those portions of the pumping chambers 42 and 43 respectively registering with the fluid inlet ports 33 in the support plates 23 and 24. The fluid discharge zones comprise those portions of the pumping chambers 42 and 43 registering respectively with the accurately shaped fluid discharge ports openings 34 in support side plates 23 and 24. Fluid flows to inlet zones through inlet port 17 into the inlet chamber 44 through passages 33 formed in support plates 23 and 24 into the space between the internal contour 28 and the periphery of rotor 25.

It has been the practice in devices of this type to provide the rotor 25 with a plurality of radial vane slots 45, each of which has a vane 26 slideably mounted therein. The contour of cam ring 27 includes an inlet rise zone, an intermediate arcuate zone (precompression) an outlet fall zone, and another intermediate arcuate zone (decompression) which are shown in FIG. 3; all of these portions constitute a pumping cycle. The cam contour is symmetrical about the minor axis; thus, each arcuate portions are duplicated in the other opposed portion of the contour. As the tips of the vanes 26 carried by the rotor 25 and the vane tips traverse the intervane spaces vary to correspond to the inlet rise, arcuate dells, and discharge fall zones dictated by the internal contour 28 of cam ring 27. The spacing between each pair of vanes is adapted to span the distance between each port in both axial support surfaces 46 and 47 on support side plates 23 and 24 in a manner to provide proper sealing between the inlet and outlet chambers of the pumping device.

The pump cartridge 22 is fastened together by two (2) screws 50. Screws 50 extend through support side plate 23 and cam ring 27 into threaded holes in support plate 24. Screws 50 also locate the cam ring 27 to correspond to the pump timing on the valve faces 46, 47, support side plates 23 and 24. The installed cartridge 22 in pump assembly 20 is internally located by two stator pins 51 located in the support plate 23 and housing cover 21*b*.

Referring to FIGS. 1, 2 and 3, the undervane chamber 38 of each vane is provided with fluid pressure by passage 36 in support side plates 24 and 23. During the fluid discharge the vanes 26 are inwardly displaced by the internal contour 28 and the displaced undervane fluid volume is forced into passage 37 and out through restricted opening 40 into the discharge chamber 18. The resulting increased pressure in the undervane chambers 38 assist the vanes 26 to maintain tip contact with the internal contour 28 during the fluid displacement.

Referring to FIGS. 1, 2, 2A and 3, an axial passage 30 is located in each angular segment of rotor 25. The axial passage 30 is continued through the length of the rotor 25 to create an axial port 30*a* on both sides of the rotor. A radial port 29 is inwardly located on the rotor periphery to intersect each axial passage 30. Two (2) access ports 31 per pump cycle are located at each axial support surfaces 46 and 47; one access port 31 is located in the inlet to discharge (precompression) zone and the second access port 31 is located in the discharge zone. The angular and radial location of the two access ports 31 are strategically timed with the two consecutive axial ports 30*a* in rotor 25. A sized passage 32 connecting access ports 31 is located beneath the axial support surfaces 46 and 47.

When the intervane volume is located in the inlet to transition (precompression) zone and sealed from the fluid inlet ports 33 the axial ports 30*a* in rotor 35 begin to register with the access ports 31 in the valve faces 46 and 47. Pressurized flow enters the radial port 29 in rotor 25 and is directed by the axial ports 30*a* to enter the access ports 31 and continues in passage 32 to exit in intervane volumes traversing the precompression zone. The openings of the radial ports 30*a*, connecting passage 32 and the varied opening between the registering access ports 31 with the axial port 30*a* provide the multistaged flow restrictions to reduce the outgassing of throttled pressurized flow.

As a design supplemental flow option a precompression pressure metering groove 39 can be located on one or both axial support surface faces 46 and 47. The metering groove 39 is extended from the discharge port 34 into the inlet to discharge transition (precompression zone).

Referring to FIG. 3, another means to enhance the precompression is to include a fall 35 in the precompression zone of the internal contour 28 of cam ring 27. As the intervane volume traverses the precompression zone its volume is gradually reduced and the trapped fluid is mechanically compressed.

Referring to FIG. 1A, an alternate design would have the connecting passage 32 of access ports 31 replaced with an on the surface access groove 32*a*.

Figure 1B:
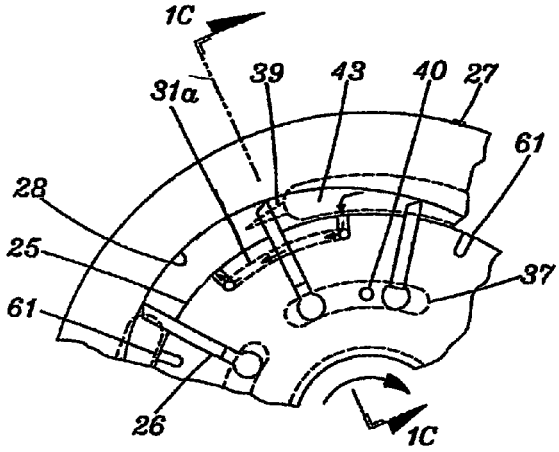
FIG. 1B is an enlarged fragmental elevational view of the invention featuring an alternative means locating the precompressive flow porting design on the rotor sides and on the axial support surfaces.
Figure 1C:
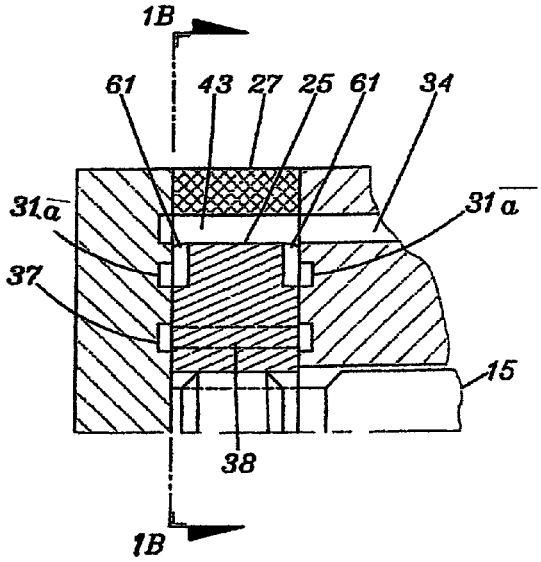
FIG. 1C is a section axial view along line 3-3 in FIG. 1B.

Referring to FIG. 1B and FIG. 1C therein axial passage 30 and radial port 30*a* are replaced by inward radial grooves 61 on both sides of the rotor. The terminated end of the radial grooves 61 register with an access groove 31*a* on the axial support surfaces of the support side plates 23 and 24. The access grooves 31*a* would eliminate the axial passages 30 and the accompanying axial ports 31.

Figure 4:
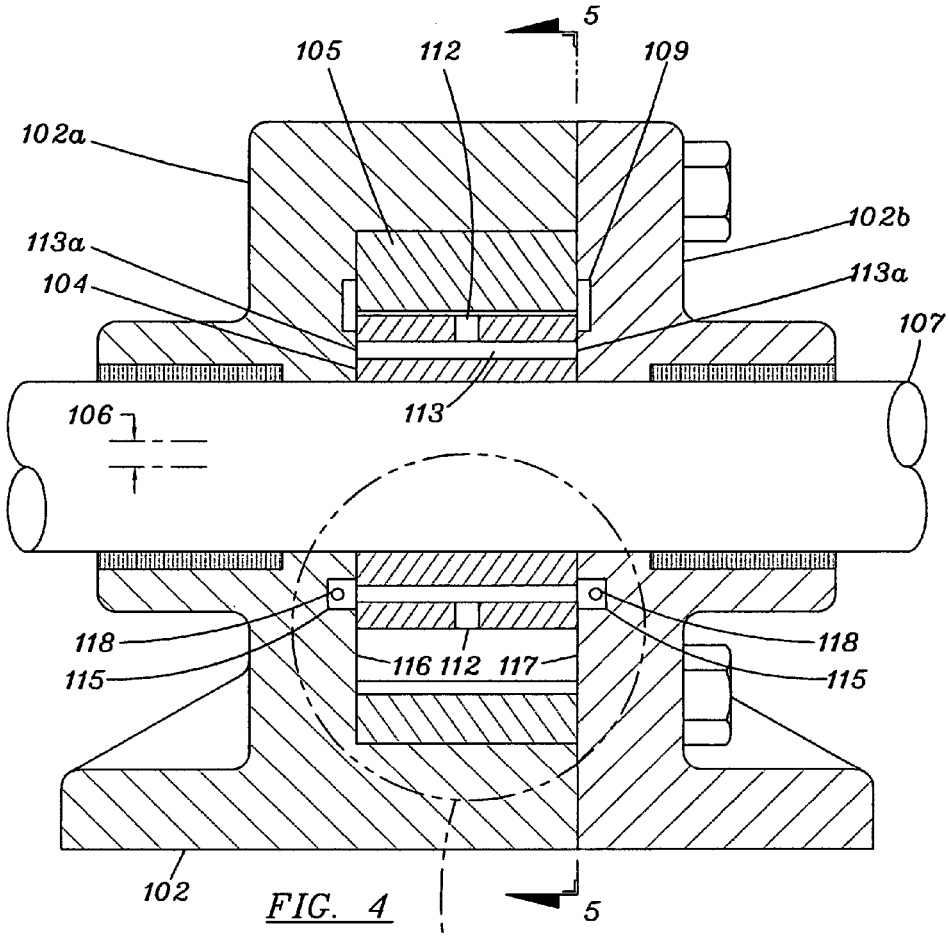
FIG. 4 is an axial section view line 4-4 in FIG. 5 of a gerotor displacement unit embodying the invention.
Figure 5:
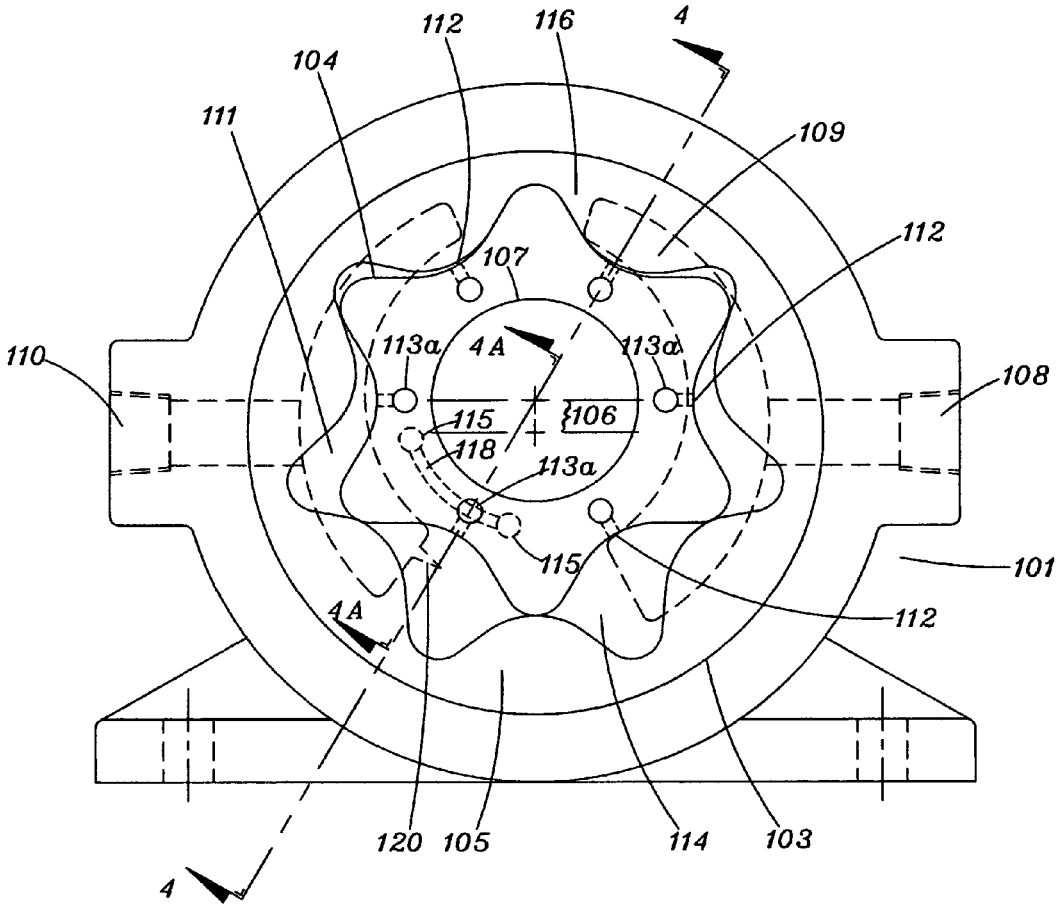
FIG. 5 is a sectional elevation view of a gerotor displacement unit with the embodying invention.
Figure 6A:
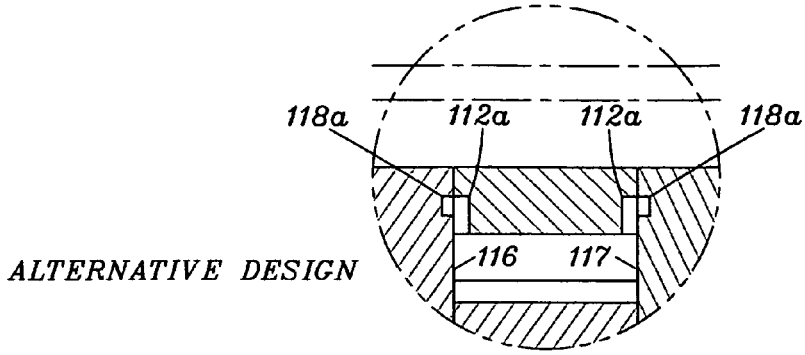
FIG. 6A is a fragmental axial section view along line 6A-6A in FIG. 6.
Figure 6:
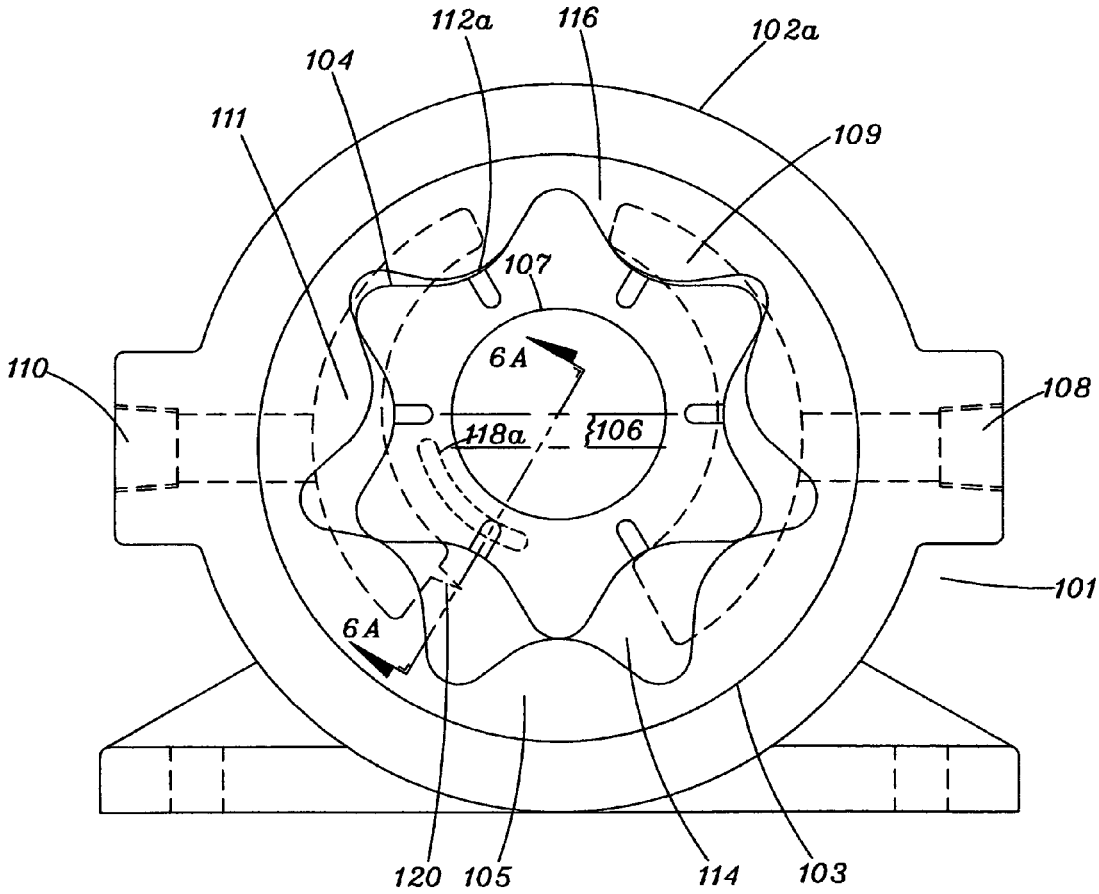
FIG. 6 is an elevational view of gerotor displacement unit with the embodying invention showing an alternate design for connecting the precompression flow paths on the sides of the rotor and on the axial support surfaces.

Referring to FIGS. 4, 5 and 6 there is a gerotor gear type positive displacement device or pump 101 comprising of a housing 102 which consists of body 102*a* and cover 102*b* and a gerotor set 103 consisting of an inner rotor 104 and outer rotor 105 located radially and axially within housing 102. The outer rotor 105 has one or more teeth than the inner rotor 104 and has its centerline positioned at a fixed eccentricity 106 from the centerline of the inner rotor 104 and drive shaft 107.

The housing body and cover 102*a* and 102*b* possess the pump timing of inlet, transition of inlet to discharge (precompression), discharge, and transition of discharge to inlet (decompression) zones. The inlet connection port 108 is connected to the inlet chamber 109 and the outlet connection port 110 is connected to the discharge chamber 111.

Referring to FIG. 4, therein is the inner rotor 104 with porting to achieve multistaged restrictions in directing pressurized fluid flow for precompressing the intertooth volumes prior to displacement. On the root diameter, radial passages 112 are located between each set of teeth to intersect with axial passage 113 which creates axial ports 113*a* on both sides of the inner rotor 104.

Referring to FIGS. 4 and 5 therein is pump housing 102 with the porting to achieve multistage restrictions for pressurized flow into the intertooth volume 114 to be displaced. The access ports 115 can be located on one or both axial support surfaces 116, 117. The access ports 115 are located radially and angularly to correspond with two (2) consecutive axial ports 113*a* of the inner rotor 104. On the axial support surfaces 116, 117 and access ports 115 are located in the inlet to discharge transition zone and at a position to begin registering with axial port 113*a* in the inner rotor 104 when the enlarged intertooth volume 114 is sealed from the inlet chamber 109. The second access port 115 is located in the discharge zone to identically sequence its opening with the trailing axial port 113*a* in inner rotor 104. The two access ports 115 on each support walls 116, 117 are connected with a sized passage 118 which are located beneath the axial support surfaces 116, 117.

Figure 4A:
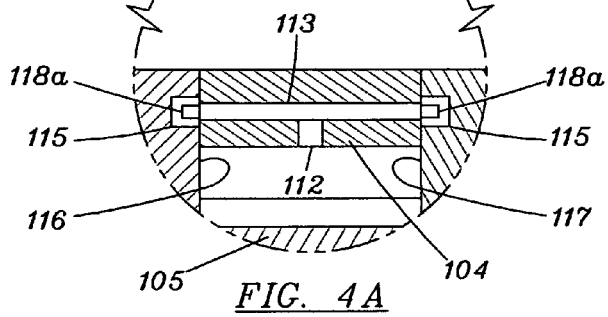
FIG. 4A is a fragmental axial view along line 4A-4A in FIG. 5 of an alternative design for connecting the access ports with a passage on the axial support surfaces.

Referring to FIGS. 4A, 6 and 6A, passage 118 is replaced with an alternative design passage 118*a* which is located on the support surfaces 116, 117.

Referring to FIGS. 4 and 5, as the inner and outer rotor 104, 105 revolve about their respective axis, fluid is drawn from the inlet chamber 109 into the enlarging intertooth space 114 between the engaged teeth of the inner and outer rotors 104, 105. When the intertooth space 114 is at its optimum volume it is sealed from the inlet chamber 109. The axial ports 113*a* in the inner rotor 104 begin registering with both access ports 115 on the axial support surfaces 116, 117. Pressurized flow from the discharge chamber 111 enters into the radial port 112 and is directed by the connected axial port 113 into the access ports 115 and through passages 118 to the connected access ports 115. The pressurized flow enters the trailing axial port 113*a* and continues through the trailing radial port 112 into the intertooth space 114, which is about to be reduced by the engaging teeth of the inner and outer rotors 104, 105. The fluid volume in each intertooth space 114 is precompressed by the admitted conditioned flow prior to its displacement. The pressurized flow for precompression was directed through a series of restrictions which constituted the multistaged restrictions to minimize the outgassing associated with single staged throttling pressurized flow.

An optional pressure meter groove 120 is extended from the discharge 111 into the precompression zone to supplement the pressurized flow for precompressing the intertooth volume 114 prior to its displacement.

Referring to FIGS. 6 and 6A, a preferred embodiment of the present invention is to replace the axial port 113 and radial port 112 in the inner rotor 104 with a strategic inward radial groove 112*a* on one or both sides located between each pair of teeth and at the root diameter. This radial groove and its ending would be sized and located to register with access groove 118*a*.

Figure 7A:
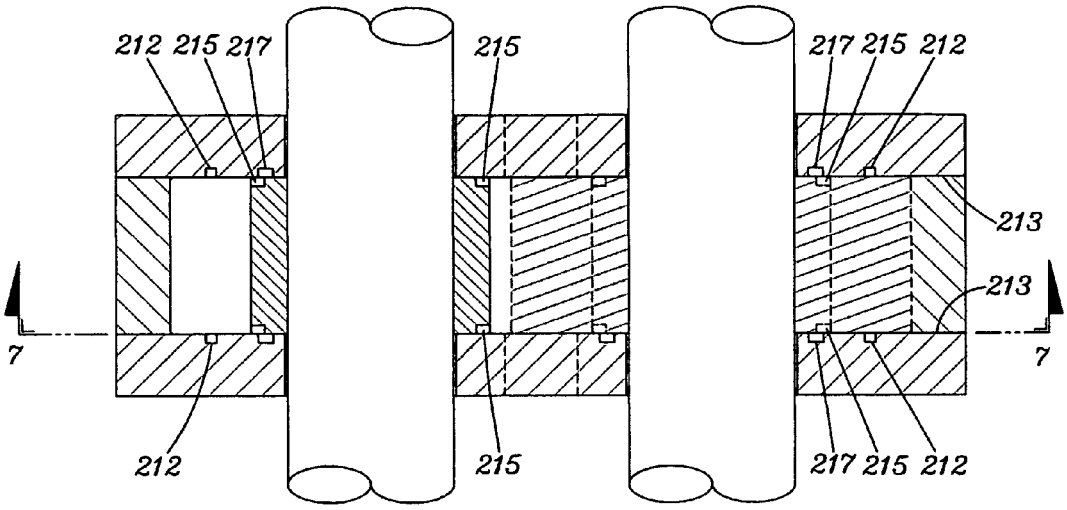
FIG. 7A is a sectional axial view taken along line 7A-7A in FIG. 7.
Figure 7:
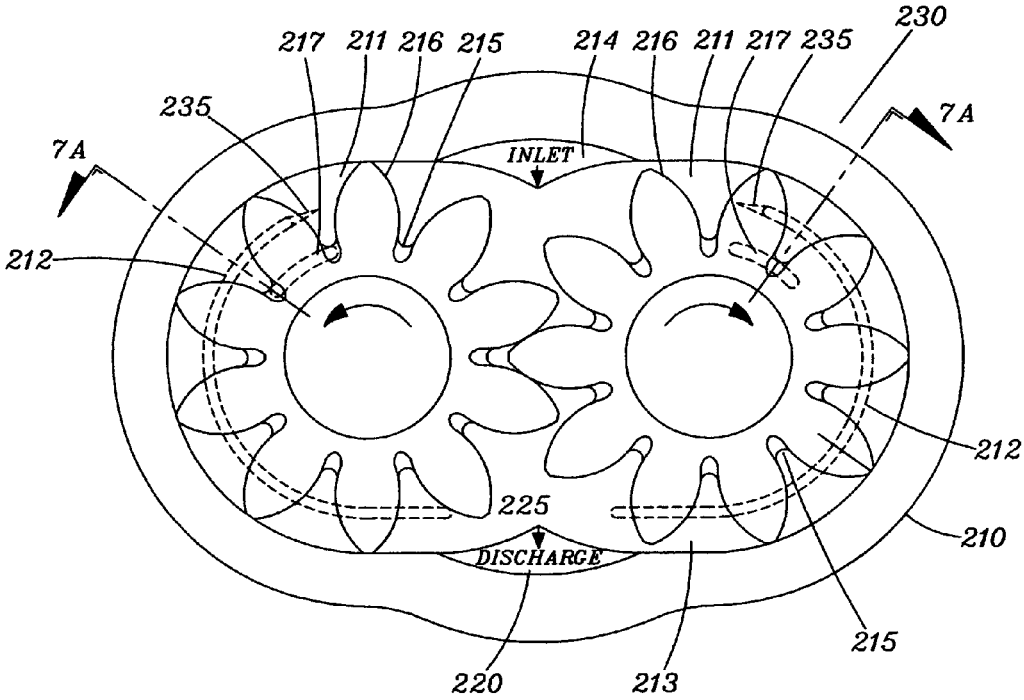
FIG. 7 is an elevational view of a spur gear pump rotating group embodying the invention.

Referring to FIGS. 7 and 7A, therein pump assembly 230, a partial vacuum is created in the pump inlet 214 as the rotating gears 216 unmeshed. Fluid is drawn into the intertooth spaces 211 and carried by the rotating gears 216 to the region 225 where the gears 216 meshed and the entrapped fluid volumes are displaced. The multistaged precompression of the intertooth volumes to be displaced is accomplished by communicating the pressurized pump discharge in port 220 with recessed and open grooves 212 located one or both axial support surfaces 213 and strategically terminated near the inlet port 214. Inward radial grooves 215 are located between the gear tooth and on the minor diameters of the spur gears 216. Two (2) arcuately shaped access grooves 217 are located on axial support surfaces 213 and diametrically extended to at least communicate between two (2) consecutive radial grooves 215. The timing locations of the access grooves 217 are to engage the radial grooves 215 when the gear teeth 216 radially seals the intertooth volume 211 from the inlet 214. As the radial groove 215 engages access groove 217 the discharged pressurized flow supplied by groove 212 is directed through radial groove 215 and through access groove 217 and out through the trailing radial groove 215 to precompress the intertooth volume 211 which completed the filling cycle and is radially sealed from the inlet 214 by the trailing gear tooth 216. The timing and engagement of the radial groove 215 with access groove 217 creates a series of flow restrictions which diminishes the amount of outgassing of the dissolved gasses in the fluid during the precompression of each intertooth volume to be displaced.

The described porting of the staged precompression of the volume 211 to be displaced can be applied on one or both sides of the rotating spur gear displacement group 210.

As a design supplemental flows option a precompression pressure metering groove 235 is extended from circular groove 212 toward the inlet port.

I claim:

1. A fluid pressure energy translating device of a sliding vane type comprising:

a cam ring including an internal contour, a rotor having a plurality of vanes notable therewith and slideable thereto in slots in rotor with one end of each said vane engaging said internal contour, each said vane has an undervane chamber which is subject to discharge to urge engagement contact with said internal contour, an axial passage in said rotor is located between each pair of vane slots and providing an axial port on each side of said rotor, a radial port is located on the peripheral surface of said rotor and between each pair of said vane slots inward to intersect with said axial passage, said rotor and said cam ring with said internal contour configuration to define one or more pumping cycles between the said periphery of said rotor and said internal contour by which said vanes carry fluid from the inlet port to the outlet port, each said pumping cycle consists of an inlet zone, an inlet to discharge (precompression) transition zone, a discharge zone, and a discharge to inlet (decompression) transition zone, axial support surfaces are provided to retain and guide the rotating group consisting of said rotor and said vanes, said axial support surfaces contain valve timings to define said pumping cycle with respect to said internal contour, each said valve timing contains strategically located access ports to radially correspond to said axial ports in said rotor, said access port is strategically located in the inlet to discharge (precompression) zone, another said access port is strategically located in the discharge zone, both said access ports are located to angularly correspond to two (2) consecutive said axial ports in said rotor, both said access ports are connected by a passage located beneath the surface of each said axial support surface, the angular location of both access ports control the registered opening with said axial ports in said rotor when the intervane volume has completed the filling cycle and is sealed from said inlet port, and the registered opening between said axial ports in said rotor and said access ports complete the circuit for directing pressurized flow through several restrictions and into said intervane volume in said precompression zone.

2. The device set forth in claim 1 wherein said passages connecting said access ports are access grooves located on said axial support surfaces.

3. The device set forth in claim 1 wherein said valve timing includes pressure metering grooves, beginning at said discharge ports and extending into said transition zones of inlet to discharge.

4. The device set forth in claim 1 wherein said internal contour contains a prescribed fall during said transition zone of inlet to discharge.

5. The device set forth in claim 1 wherein said features of claims 2, 3 and 4 are included.

6. The device set forth in claim 5 and with said axial passages and said axial ports are replaced by grooves on the sides of said rotor radially extended downward from said rotor periphery to register with said access grooves on both said axial support surfaces.

7. The device set forth in claim 5 with said radial grooves on said rotor and the corresponding access grooves are located on one axial support surface.

8. The device set forth in claim 1 wherein said features of claims 3 and 4 are included.

9. A fluid pressure energy translating device of gerotor gear type displacement comprising:

gerotor set consisting of an inner rotor and outer rotor, said outer rotor possesses one or more teeth than said inner rotor and are on the inside diameter, said inner rotor possesses teeth located on the outside diameter, tooth profile of said inner and said outer rotors are generated to provide continuous fluid tight sealing during operation, centerline of said outer rotor is at a fixed eccentricity from the centerline of said inner rotor and engaged shaft, said inner rotor is located internally to engage the teeth of said outer rotor, pump timing of inlet, inlet to discharge transition, discharge, and discharge to inlet transition are depicted on the axial support surfaces, said rotating gerotor set is radially and axially retained with close clearances by said pump housing, said inner rotor is driven by said shaft which is located and supported by the pump housing, said inner rotor has radial grooves on its sides and located on the gear minor diameter and between each set of teeth, each said radial grooves of are downwardly directed to register with access grooves located on the axial support surfaces, said access grooves of are located on said each axial support surface to correspond radially and angularly with said radial grooves, said access groove spans part of the inlet to discharge transition zone and part of the discharge zone, the position of said access groove is located to begin registering with said radial grooves on said inner rotor when the engaged gears inter tooth space in said inlet to discharge transition zone is sealed from said inlet port by the trailing gear teeth engagement and the next leading said radial groove is registered with said access groove, and an angular length of said access groove is at least the angular distance between two consecutive radial grooves on said inner rotor.

10. The device set forth in claim 9 except said radial grooves and the corresponding access grooves are located on one said axial support surfaces.

11. The device set forth in claim 9 except the radial grooves are replaced by axial passages through said inner rotor and with a radial passage located inward between said teeth to intersect said axial passage.

12. The device set forth in claim 9 wherein the axial support surface has a pressure metering groove beginning at said discharge port and extending toward said inlet to terminate in the discharge transition zone.

13. A fluid pressure energy translating device of a spur gear type unit comprising:

a set of two engaged spur gears, a tooth profile of said gear set is generated to provide continuous sealing contact at the engagement during operation, each said spur gears have concentrically located journals to precisely locate said gears and to provide hydrodynamic support of the radial loads, the pump valve timing is located on the axial support surface, a circular groove is located on the axial support surface to distribute discharge pressure around the gear peripheries, said circular groove is terminated to provide at least one said gear tooth width seal between said distributed discharge pressure and said inlet port, radial grooves of are downwardly located between said spur gear teeth and on the gear minor diameter, the access grooves for communicating with said radial grooves are located on said axial support surfaces of the side plates, the beginning of said access grooves registers with said radial grooves when the inter tooth space completes the inlet filling cycle and the trailing said gear tooth seals the inlet port, the angular distance of said access groove is at least, the angular distance of two consecutive said radial grooves on the gears, and said radial grooves are located on both sides of the rotor and said access grooves are located on both axial support surfaces of the side plates.

14. The device set forth in said claim 13 wherein said radial grooves are located on one side of said rotor and said access grooves are located on the same correspondence axial support surface.

15. The device set forth in claim 13 wherein the axial support surfaces have a pressure metering groove beginning at end of said circular groove and terminating when said inter tooth space completes its inlet cycle.

* * * * *